United States Patent [19]

Pepin et al.

[11] Patent Number: 5,054,917

[45] Date of Patent: Oct. 8, 1991

[54] AUTOMATIC BORESIGHTING DEVICE FOR AN OPTRONIC SYSTEM

[75] Inventors: Christian Pepin, Gif/S/Yvette; Vincent Vilbois, Montigny Le Bretonneux; Marc Audion, Massy, all of France

[73] Assignee: Thomson-CSF, Puteaux, France

[21] Appl. No.: 581,796

[22] Filed: Sep. 13, 1990

[30] Foreign Application Priority Data

Sep. 19, 1989 [FR] France ..... 89 12257

[51] Int. Cl.[5] ..... G01B 11/26; G02B 23/10

[52] U.S. Cl. ..... 356/152; 250/203.2; 250/206.1; 250/206.2; 356/251; 356/252

[58] Field of Search ..... 250/201.9, 203.2, 206.1, 250/206.2; 356/152, 142, 147, 251, 252; 350/101, 566

[56] References Cited

U.S. PATENT DOCUMENTS

| | | | |
|---|---|---|---|
| 3,644,043 | 2/1972 | Jones et al. | 356/152 |
| 4,155,096 | 5/1979 | Thomas et al. . | |
| 4,422,758 | 12/1983 | Godfrey et al. . | |
| 4,798,462 | 1/1989 | Byren | 356/152 |

FOREIGN PATENT DOCUMENTS

| | | | |
|---|---|---|---|
| 179186 | 4/1986 | European Pat. Off. . | |
| 0287032 | 10/1988 | European Pat. Off. | 250/203.2 |
| 2602347 | 2/1988 | France . | |
| 2132049 | 6/1984 | United Kingdom . | |

OTHER PUBLICATIONS

Optical Engineering, vol. 20, No. 6, Nov.-Dec. 1981, pp. 854-860, Society of Photo-Optical Instrumentation Engineers, Bellingham, Washington, U.S.; T. E. godfrey et al.: "Boresighting of airborne laser designator systems".

*Primary Examiner*—Stephen C. Buczinski

*Attorney, Agent, or Firm*—Oblon, Spivak, McClelland, Maier & Neustadt

[57] ABSTRACT

This system enables the boresighting of the optical axes of a system comprising, for example: an infrared distance measuring device, a television camera, sensitive in the visible band, and a laser telemeter which does not emit radiation in the ranges of spectral sensitivity of the distance measuring device and of the camera. One embodiment includes:

- a collimated radiation source, associated with the laser;
- a wide-band collimator including, in its focal plane, a screen with holes cut out in it, constituting a reticle illuminated by an incandescent bulb, the surface of the screen being covered with glass micro-beads. The source associated with the laser forms a light spot on the screen, and this light spot is visible to the television camera. The holes form a reticle visible both to the television camera and to the distance measuring device. The distance measuring device determines the distance between the image of the reticle and a reference point on its image sensor. An image processor associated with the television camera determines the distance, on the image sensor of the camera, between the image of the reticle and the image of the light spot.

7 Claims, 8 Drawing Sheets

AUTOMATIC BORESIGHTING DEVICE FOR AN OPTRONIC SYSTEM

BACKGROUND OF THE INVENTION

1. Field of the Invention

The invention concerns an automatic boresighting device for an optronic system comprising a laser and two image sensors working respectively in two different ranges of spectral sensitivity. For example, the system includes: a laser telemeter, a distance measuring device, and a tracking and identification device. These devices include a common optical channel constituted notably by means for directing a common line of sight. The boresighting consists in superimposing the optical axes of these three devices so that they have a common line of sight. In general, a boresighting performed on a test stand, in the factory, is not preserved after a certain amount of time of operational use of the system. It should be possible to redo the boresighting during operational use, as a particular stage of operation, and the boresighting should be automatic. Moreover, it is desirable to be able to change a sub-assembly of the system, notably the laser telemeter, without having to redo the manual adjustments.

The invention more particularly concerns the optronic systems in which the distance measuring device and the tracking and identification device respectively include two image sensors, working respectively in two different ranges of spectral sensitivity, having no common wavelength. For example, the distance measuring device has an image sensor working in the 3–5 micrometer band or in the 8–12 micrometer band to localize a target in elevation and in bearing, while the identification and tracking device has an image sensor working in the 0.7 to 0.9 micrometer band, that is, in the visible and near infra-red radiation band. In certain applications, the laser telemeter emits a wavelength that belongs to none of these ranges of spectral sensitivity, for example a wavelength of 1.54 micrometers.

2. Description of the Prior Art

The U.S. Pat. No. 4,155,096 describes an automatic boresighting device for an optronic target designator system, comprising an image sensor and a laser. The laser has a 1.06 micrometer wavelength, which belongs to the range of spectral sensitivity of the image sensor extending from 0.4 to 1.1 micrometers. This boresighting device includes a cube corner, towards which the line of sight is directed, during the boresighting. The boresighting further consists in turning on the laser. The cube corner reflects a fraction of the laser beam towards the image sensor. The laser beam therefore forms a light spot on the image sensor. An image processing operation makes it possible to determine the distance between this spot and the centre of the image sensor and to deduce a boresighting correction therefrom. This known device cannot be used when the laser does not have a wavelength within the range of spectral sensitivity of the image sensor.

The U.S. Pat. No. 4,422,758 describes a boresighting device for an optronic target-designation system. This system comprises: a laser working at 1.06 micrometers, an image sensor in the visible radiation range and an image sensor in the infrared radiation range. The boresighting device includes a collimator towards which the line of sight is pointed during boresighting. A refractory target is placed in the focal plane of the collimator. The laser is turned on and its radiation is focused on to the target to create a hot spot emitting visible rays and infra-red rays. The image of this hot spot is detected simultaneously by the two image sensors and enables the measurement of the errors of boresighting of the axis of the laser with respect to the axes of the two image sensors. This device has the drawback of making it necessary to focus a substantial amount of energy on the refractory target. It is not easy to obtain a very hot target when the laser has only medium power or low lower. Moreover, the use of the laser leads to a certain degree of energy consumption and to a certain reduction in the lifetime of the laser.

SUMMARY OF THE INVENTION

An aim of the invention is to propose a boresighting device that is independent of the power and wavelength of the laser. An object of the invention is a device enabling a boresighting operation to be performed in two steps. A first step is carried out by means of a source that is associated with the laser, so as to have the same optical axis, and emits in the range of spectral sensitivity of a first sensor. A second step is carried out by means of a wide-band collimator comprising, in its focal plane, a reticle that emits rays in the ranges of sensitivity of both sensors, and is visible simultaneously to both these sensors.

According to the invention, there is proposed an automatic boresighting device for an optronic system including a single pupil for a laser, a first and a second image sensor, working respectively in two different ranges of spectral sensitivity;

said device including:

a collimated radiation source, associated with the laser, emitting in the optical axis of the laser, with a wavelength belonging to the range of spectral sensitivity of the first sensor;

optical means reflecting the radiation from the source associated with the laser, to form a light spot on the first sensor;

a wide-band collimator including, in its focal plane, a screen with holes cut out in it, constituting a reticle illuminated by a source emitting in both ranges of spectral sensitivity, said collimator being placed so that it is visible simultaneously to the first image sensor and to the second image sensor, to form two images of the reticle on these sensors respectively;

means to measure the distance, on the first sensor, between the position of the image of the reticle and the position of the spot formed by the source, and to deduce a first boresighting correction therefrom;

means to measure the distance, on the second sensor, between the position of the image of the reticle and a reference point, and to deduce a second boresighting correction therefrom.

BRIEF DESCRIPTION OF THE DRAWINGS

The invention will be understood more clearly from the following description and from the figures that accompany it.

DESCRIPTION OF PREFERRED EMBODIMENTS

Figure 1:
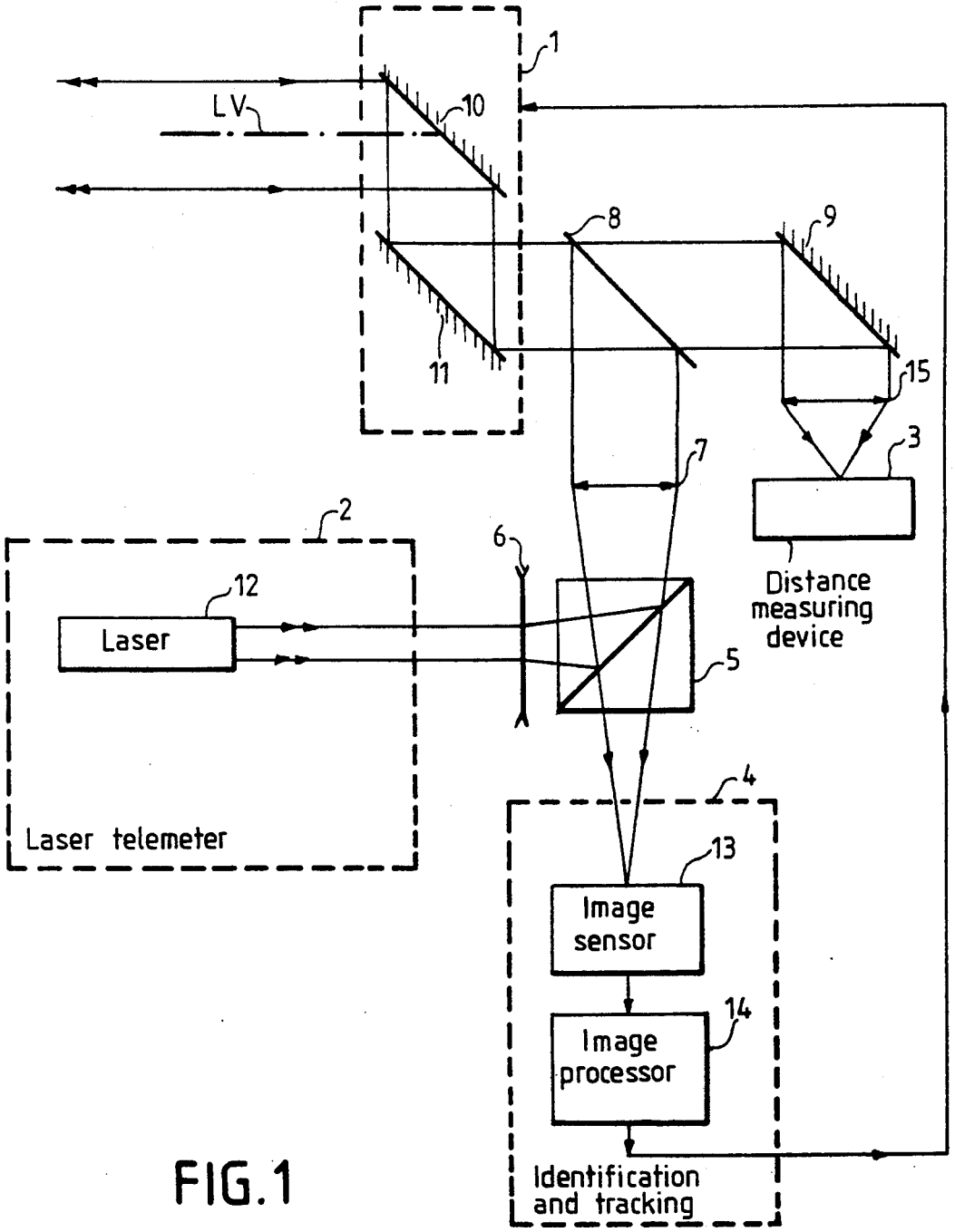
FIG. 1 shows the block diagram of a standard optronic system comprising a laser telemeter, an identification and tracking device and a distance measuring device.

FIG. 1 shows an example of a standard optronic system, without a boresighting device, in order to illustrate the working of the system during its use outside the boresighting period. This system has:

a telemeter 2, including essentially a laser 12 emitting at the 1.54 micrometer wavelength;

a distance measuring device 3 including notably an image sensor sensitive in the infra-red range, from 0.7 to 0.9 micrometer;

a target identification and tracking device 4, including essentially an image sensor 13 and an image processor 14.

The telemeter 2, the distance measuring device 3 and the device 4 have a common line of sight LV which can be directed by means of a common aiming head 1, including movable mirrors 10 and 11, moved by servomechanisms (not shown) that are controlled by signals given by the image processor 14 in order to track a target. The rays received by the system are separated by a dichroic strip 8 which lets through the infra-red radiation intended for the distance measuring device 3 and reflects the visible radiation intended for the device 4. The infra-red radiation is then deflected by a mirror 9, and then focused by a convergent lens 15 on the sensor of the distance measuring device 3. This visible radiation is then focused by a convergent lens 7 on the image sensor 13.

A dichroic cube 5 is interposed between the lens 7 and the image sensor 13, to enable the optical axis of the laser beam of the telemeter 2 to be superimposed on the optical axis of the visible radiation beam focused by the lens 7. The beam of the telemeter 2 is given by a laser 12. It goes through a divergent lens 6, then gets reflected by the dichroic surface of the dichroic cube 5, then goes through the convergent lens 7, then gets reflected by the dichroic strip 8 and finally goes through the aiming head 1. The divergent lens 6 and the convergent lens 7 form an afocal system that enlarges the laser beam in reducing its divergence.

Figure 2:
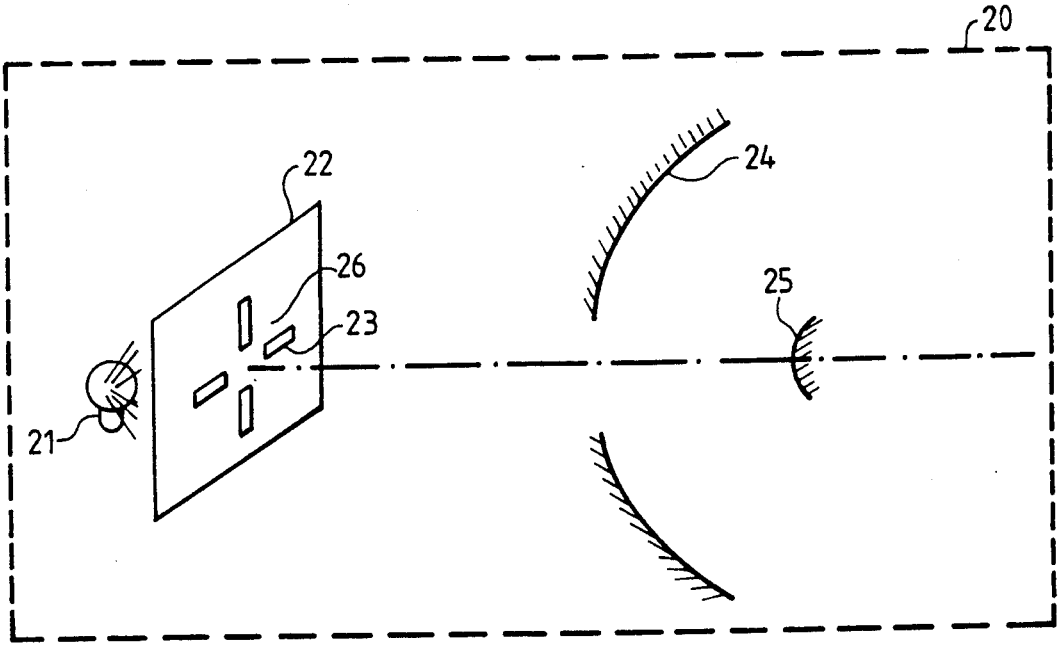
FIG. 2 shows a schematic view of a part of a first exemplary embodiment of the boresighting device according to the invention.

FIG. 2 gives a schematic view of a part of a first exemplary embodiment of a boresighting device according to the invention. This part is a wide-band collimator 20 including: a Cassegrain type catadioptric system formed by two spherical mirrors 24 and 25; a screen 22 with holes 23 cut out in it, constituting a reticle that is illuminated by a lamp 21 placed behind the screen 22. The center of the reticle is aligned with the optical axis of the mirrors 24 and 25. There are four holes 23 and every one of them is elongated. They form a cross but have no point of intersection. The surface 26 of the screen 22, on the catadioptric system side, is coated with a retroreflecting material such as the paint marketed under the brand name SCOTCHLITE by the firm 3M. This paint is constituted by micro-beads of glass fixed in a transparent binder. Each micro-bead acts like a cube corner, sending back each light ray in the direction from which it comes.

The lamp 21 is an incandescent lamp of the quartz-iode type, for example provided with a filter. This lamp emits both in the visible range and in the infra-red range. The filter enables the balancing of the light intensity emitted in the visible range and the light intensity emitted in the range of spectral sensitivity of the sensor of the distance measuring device 3.

This collimator 20 is fixedly joined to the optronic system. It is located outside the useful angular range of the system, but is located in the range accessible by the line of sight LV.

Figure 3:
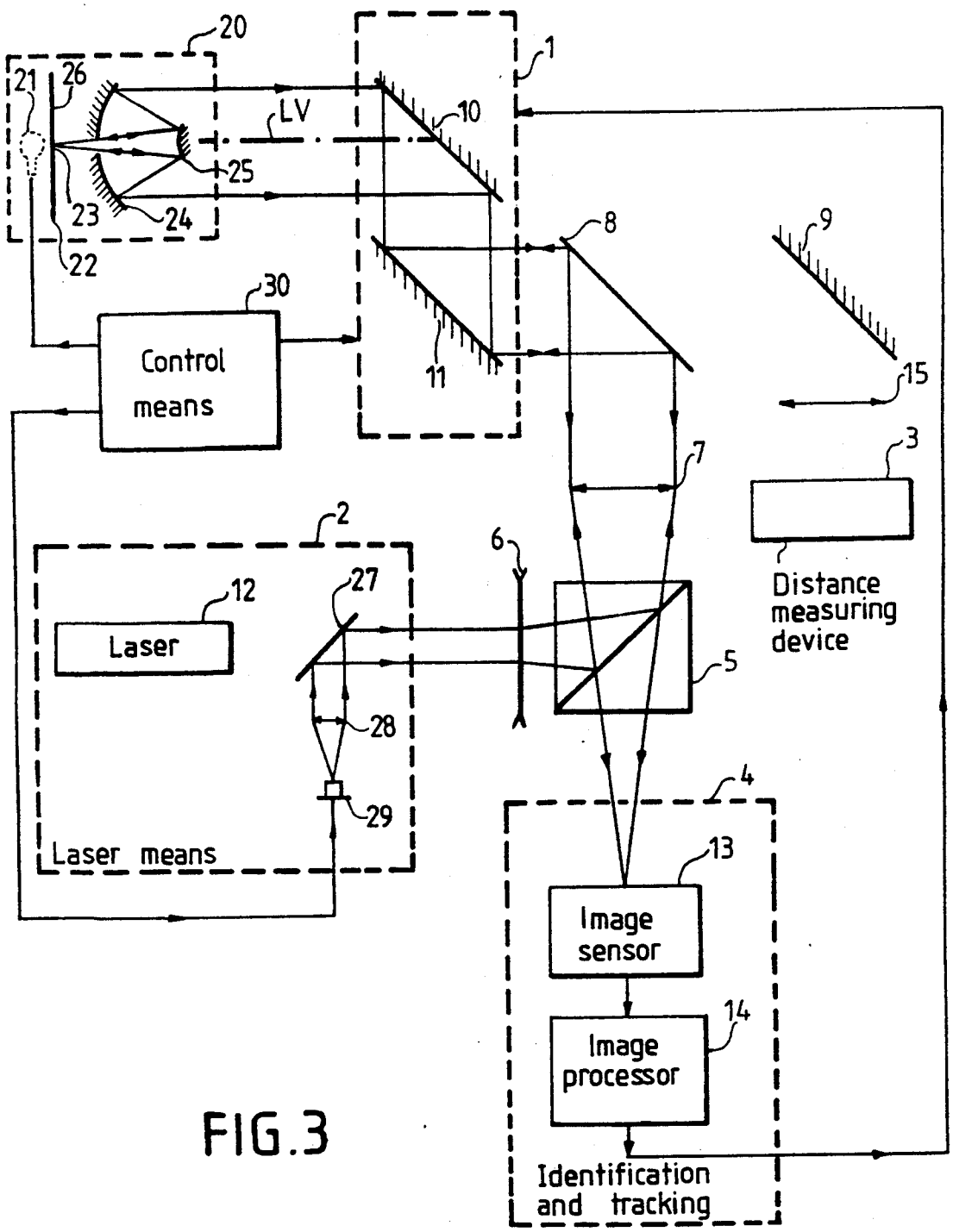
FIGS. 3 and 4 show the optronic system of FIG. 1 and a first exemplary embodiment of the boresighting device according to the invention, respectively during the two boresighting steps.

FIG. 3 shows the same system as FIG. 1 and a first exemplary embodiment of the device according to the invention. This figure illustrates a first step of boresighting wherein the optical axis of the laser 12 is boresighted with the optical axis of the identification and tracking device 4. This first exemplary embodiment of the device according to the invention comprises, in addition to the collimator 20: control means 30, and a collimated radiation source that is associated with the laser 12 so as to have an optical axis identical with that of the laser 12. This source is formed by an electroluminescent diode 29, a convergent lens 28 and a dichroic strip 27. The light beam emitted by the diode 29 is made parallel by the lens 28 and is then reflected by the dichroic strip 27 which is inclined by 45 degrees with respect to the optical axis of the laser 12. The control means 30 have outputs connected respectively to inputs of the aiming head 1, of the lamp 21 and of the diode 29.

During the first boresighting step, the control means 30 turn on not the lamp 21 but the diode 29 so that this diode 29 emits a radiation that replaces the beam of the laser 12 in having a wavelength that is in the range of sensitivity of the image sensor 13. The rays emitted by the diode 29 are reflected by the dichroic surface of the cube 5, then transmitted by the lens 7, then reflected by the dichroic surface 8, and then transmitted by the head 1 towards the collimator 20.

The control means 30 direct the line of sight LV of the head 1 towards the collimator 20 throughout the boresighting period. During the first boresighting step, the means 30 do not turn on the lamp 21, and the reticle formed by the holes 23 therefore emits no rays. The rays emitted by the diode 29 are focused by the catadioptric system 24, 25 and form a light spot on the surface 26 of the screen 22. The paint covering the surface 26 reflects these rays in the direction from which they come. They follow the same path in the reverse direction up to the dichroic cube 5. About 50% of the energy of these rays is reflected towards the telemeter 2 and about 50% of the energy of these rays is transmitted towards the sensor 13. To obtain this kind of a distribution of the reflected energy and the energy transmitted by the dichroic cube 5, it is necessary for its dichroic surface to have a transition wavelength corresponding exactly to the wavelength of emission of the diode 29. The dichroic strip 8 reflects the totality of the rays emitted by the diode 29 and the rays sent back by the collimator 20 for its transition wavelength is located at wavelengths greater than those of emission from the diode 29.

The lens 7 forms an image of the light spot, formed on the screen 22, on the image sensor 13. The processor 14 determines and memorizes the position of this image. This position forms a reference for the second boresighting step.

Figure 4:
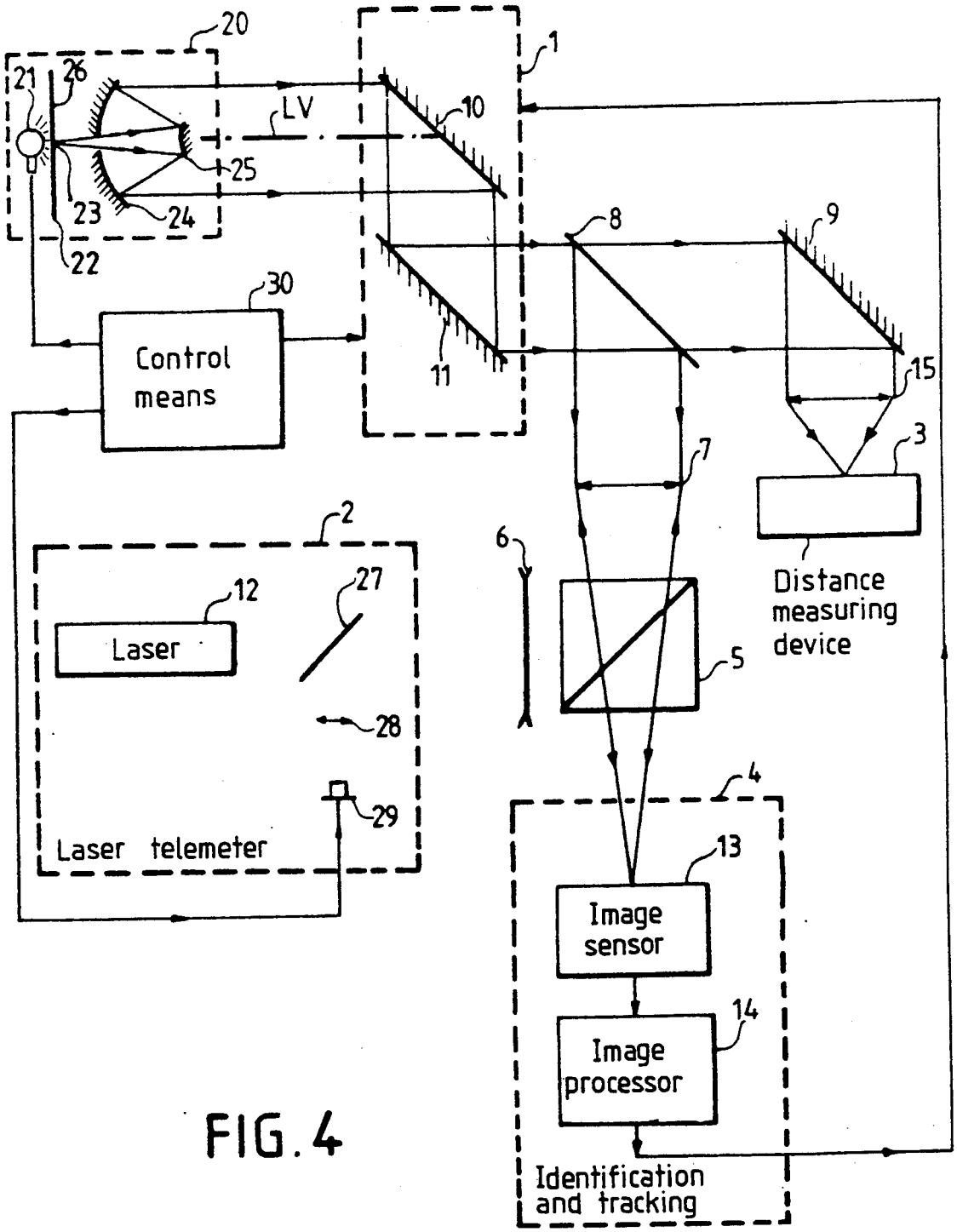

FIG. 4 gives a schematic view of the same optronic system and the same exemplary embodiment of the device according to the invention, in illustrating the second boresighting step. The control means 30 turn on no longer the electroluminescent diode 29, but the lamp 21 of the collimator 20. The line of sight LV of the head 1 remains pointed towards the collimator 20. The holes 23 cut out in the screen 22 constitute a cross-shaped luminous reticle that is visible simultaneously in the visible range and in the infra-red range owing to the wide spectrum of emission of the incandescent lamp 21. The rays emitted by the reticle are transmitted by the catadioptric system 24, 25 then by the head 1, and then they are separated into two beams by the dichroic strip 8.

The strip 8 transmits the infra-red rays towards the folding mirror 9, while it reflects the visible rays towards the lens 7. The lens 15 therefore forms an image of the reticle on the sensor of the distance measuring device 3 and the lens 7 forms an image of the reticle on the image sensor 13. The dichroic strip of the cube 5 lets through the totality of the visible rays coming from the lens 7.

The distance measuring device 3 determines the position of the image of the reticle on its sensor, with respect to a reference point of this sensor. The image processor 14 determines the position of the image of the reticle on the sensor 13, and memorizes it. It determines two coordinates expressing the distance between the position of the image of the reticle and the previously determined position of the image of the light spot formed by the diode 29 on the screen 22. The distances thus determined by the distance measuring device 3 and by the processor 14 enable the deducing, therefrom, of a first and a second boresighting correction, corresponding respectively to the boresighting error of the distance measuring device with respect to the laser and the boresighting error of the device 4 with respect to the laser.

A first possible way to carry out these corrections consists in memorizing the distances and in subtracting them from the values of the measurements performed subsequently by the distance measuring device, on the one hand, and by the processor 14, on the other hand. A second possibility of correction consists in cancelling the distance observed by the device 4, by modifying the orientation of the optical axis of the laser by means of a folding mirror mounted on three piezoelectrical wedges. The making of such a folding mirror and of the control circuits for the piezoelectrical wedges is standard. In this case, what remains to be done is to correct the distance observed by the distance measuring device 3, by subtracting this distance from the values measured subsequently by the distance measuring device 3.

Figure 5:
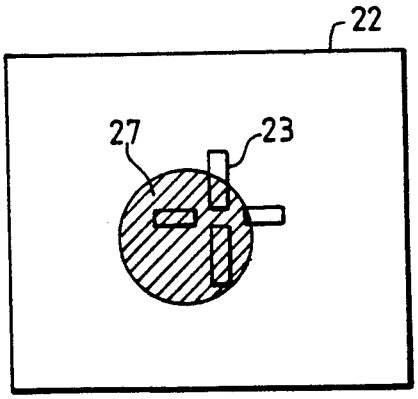
FIGS. 5 and 6 illustrate the working of the first exemplary embodiment according to the invention, and a variant of it.

FIG. 5 shows the screen 22 in a frontal view, when the light emitted by the electroluminescent diode 29 forms a light spot 27 on this screen. The light spot 27 has a circular shape and an area far greater than that of the holes 23 forming the reticle.

Figure 6:
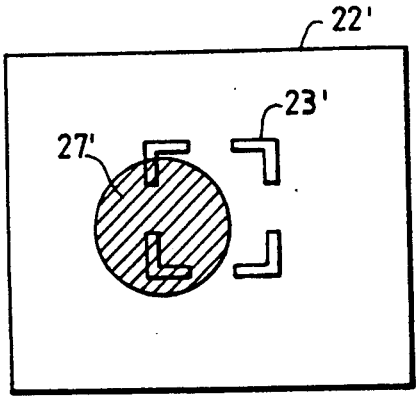

FIG. 6 shows a variant 22' of the screen 22, having holes 23' which constitute a reticle having the shape of a square, the sides of which are broken, to enable this reticle to be made by photo-etching on a metal plate, for example. The rays emitted by the diode 29 form a light spot 27'.

The width of the holes 23' of the reticle should be smaller than the diameter of the light spot 27 or 27' so that the portion of non-reflecting surface, located within the light spot, is smaller than the area of this light spot.

The boresighting done by means of the device according to the invention may be carried out in two steps, as described above, but it can also be done by simultaneously turning on the diode 29 and the lamp 21 of the collimator 20. But then, the processing of images done by the processor 14 is more complicated since, on the sensor 13, it must distinguish the image of the light spot (27) and the image of the reticle constituted by the holes 23 which are illuminated by the lamp 21. However, this discrimination can be achieved by a standard method of shape recognition by correlation, the shape of the spot 27 and the shape of the holes 23 being known a priori.

The light intensity of the image of the spot 27 and the light intensity of the image of the reticle, on the sensor 13, may be adjusted independently by acting on the intensity of the supply current of the lamp 21 and on the intensity of supply of the diode 29.

The modification of a standard telemeter to add the collimated radiation source formed by the diode 29, the lens 28 and the dichroic strip 27 is within the scope of those skilled in the art, as are the operations for setting the strip 27 to make the axis of the beam coming from this collimated source identical with the output axis of the laser. This setting can be done once and for all, in the factory. It is stable enough to enable the laser and the collimated source to be interchanged, without having to redo this setting.

Figure 7:
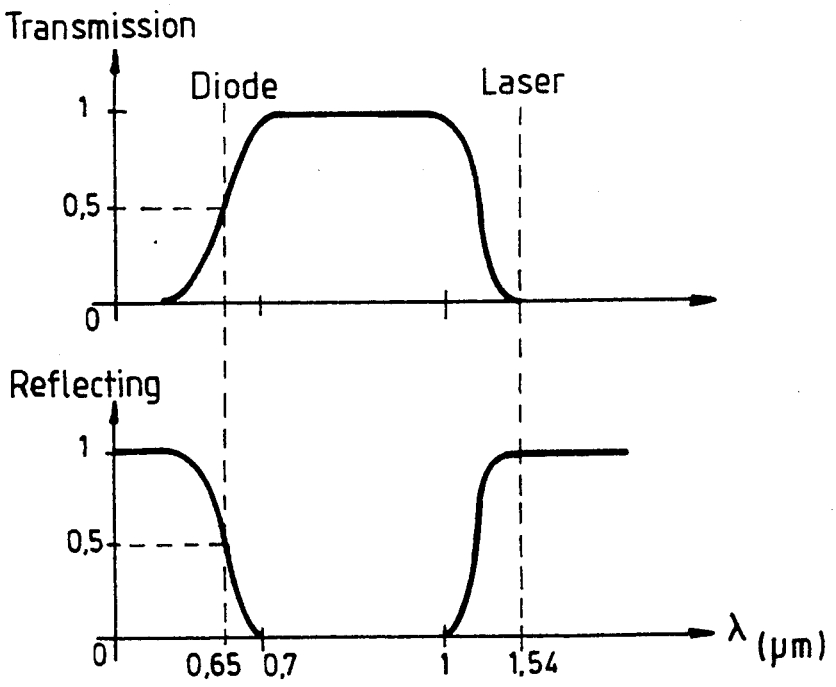
FIGS. 7 and 8 are graphs of transmission and reflection from a dichroic surface included in this first exemplary embodiment of the device according to the invention.
Figure 8:
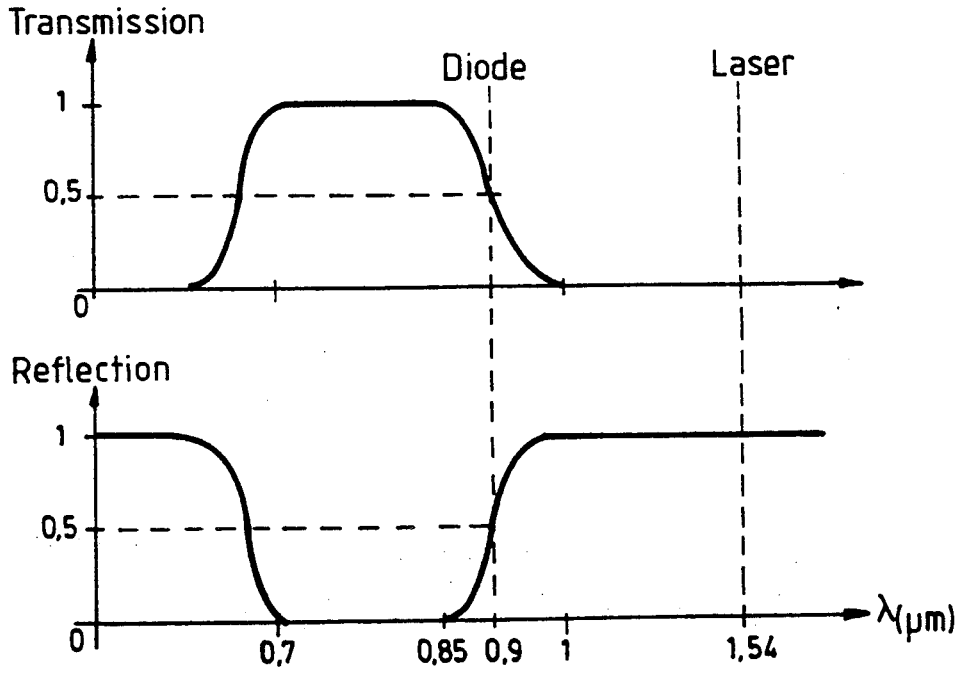

FIGS. 7 and 8 show diagrams illustrating the working of the dichroic cube 5, respectively in two variants of this first exemplary embodiment, where the electroluminescent diode 29 emits at the 0.65 micrometer wavelength or else at the 0.9 micrometer wavelength. In both cases, its emission wavelength is close to one of the limits of the range of spectral sensitivity of the image sensor 13.

Indeed, the dichroic cube 5 should meet three requirements simultaneously. It should have:

a coefficient of reflection that is close to 1 for the wavelength of the laser: 1.54 micrometers;

a coefficient of transmission that is close to 1 for the entire range of spectral sensitivity of the sensor 13: 0.7 to 1 micrometer in this example;

a coefficient of reflection and a coefficient of transmission close to 0.5 for the wavelength of the electroluminescent diode 29.

A dichroic cube such as this can be made by standard methods consisting of the deposition of multiple dichroic layers.

FIG. 7 shows the graph of the coefficient of transmission and the graph of the coefficient of reflection of the cube 5, as a function of the wavelength, for the alternative embodiment including a diode 29 emitting at the 0.65 micrometer wavelength. The two graphs are complementary, for practically all the energy that is not transmitted is reflected. The graph of the coefficient of transmission has a plateau with a value of 1 between 0.7 and 1 micrometer, with a transition at 0.65 micrometer, going to the value 0.5 for the wavelength of the diode, and a transition at over 1 micrometer, which corresponds to the limit of sensitivity of the sensor 13 while at the same time being below the wavelength of the laser: 1.54 micrometers.

FIG. 8 shows the graph of the coefficient of transmission and the graph of the coefficient of reflection of the cube 5 for the alternative embodiment comprising a diode 29 emitting at 0.9 micrometer, the laser again having the same wavelength, namely 1.54 micrometers. The graph of the coefficient of transmission has a plateau with a value of 1 between 0.7 micrometer and 0.85 micrometer approximately, with a transition at a wavelength slightly below 0.7 micrometer, which is the first limit of the range of sensitivity of the sensor 13, and a transition passing through the value 0.5 for the 0.9 wavelength which is the wavelength of emission of the diode, and is very close to the second limit of the range of sensitivity of the sensor 13, namely 1 micrometer, while at the same time being smaller than the wavelength of the laser, namely 1.54 micrometers.

Naturally, it is possible to permutate the position of the telemeter 2 and the position of the identification and tracking device 4, provided that we use a dichroic cube 5 having its graphs of the coefficients of transmission and of reflection permutated with respect to those described above.

The optical means reflecting the radiation of the source associated with the laser may be different from the micro-beads covering the surface of the screen 22 of the collimator 20. In a second exemplary embodiment, these means are formed by a metal coating constituting a plane mirror in the focal plane of the collimator. The collimator then behaves like a convergent lens provided with a plane mirror in its focal plane: it sends back a light ray parallel to itself. In a third exemplary embodiment, these means are constituted by a cube corner placed beside the collimator 20, in the angular range accessible to the line of sight LV. It is then necessary for the control means 30 to shift the line of sight successively towards the cube corner and towards the collimator 20 to carry out, respectively, the first boresighting step and the second boresighting step.

Figure 9:
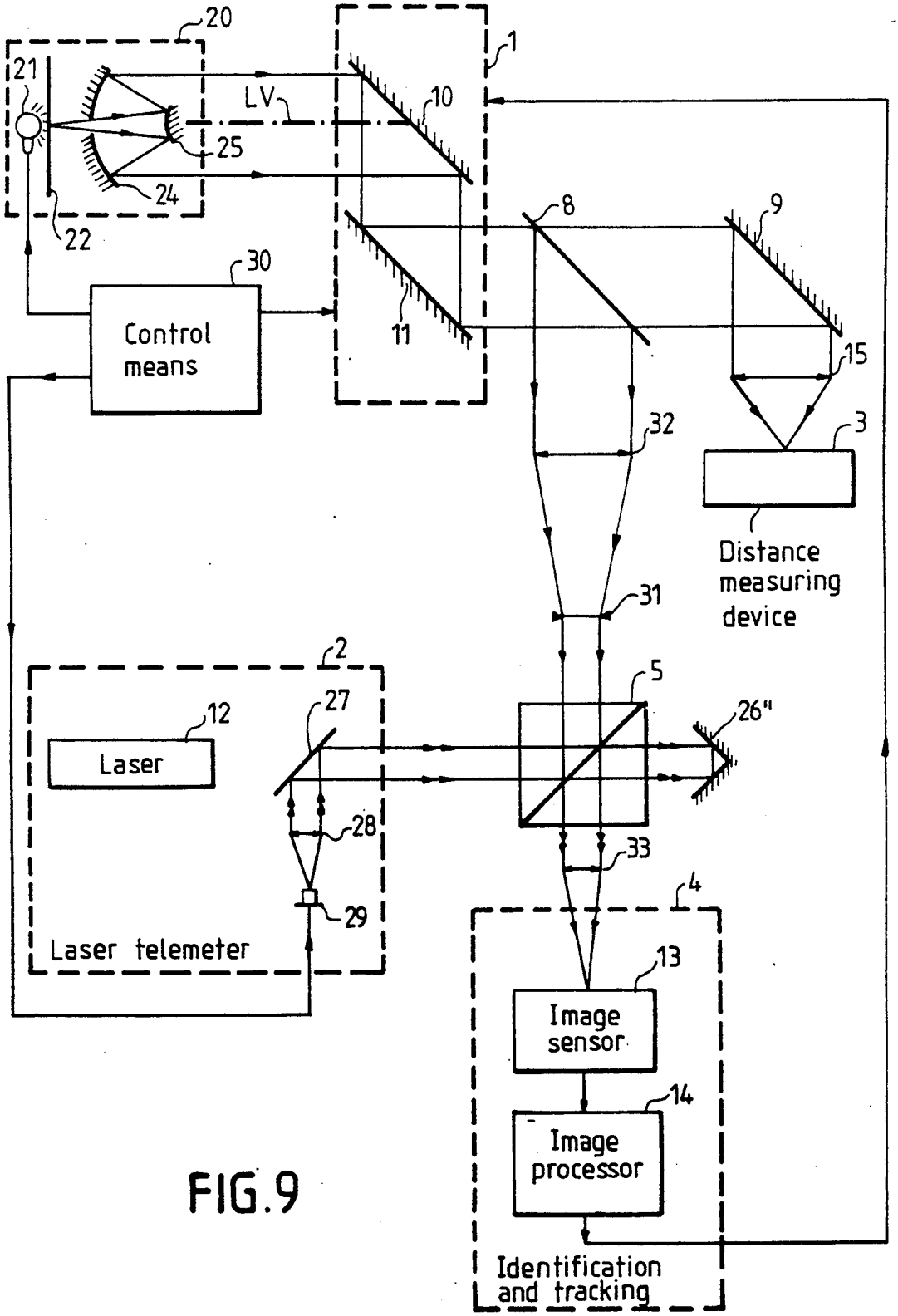
FIGS. 9 and 10 show the system of FIG. 1, provided respectively with a second and a third exemplary embodiment of the boresighting device according to the invention.

FIG. 9 shows a second exemplary embodiment of the invention, wherein the retroreflective optical means are constituted by a cube corner 26'' placed in the extension of the collimated beam emitted by the diode 29, the lens 28 and the semi-transparent strip 27, beyond the dichroic cube 5. The dichroic cube 5 is the same as in the first exemplary embodiment described above. It reflects 50% of the energy of the radiation from the diode towards the dichroic strip 8, without any utility, and it transmits 50% of it towards the cube corner 26''. The rays reflected by the cube corner 26'' are parallel to the rays reaching it, and they therefore return to the dichroic surface of the cube 5. This cube 5 reflects 50% of the energy of these rays towards the image sensor 13, where they are focused by a convergent lens 33, and it transmits 50% of the energy towards the diode 29, without any utility.

It must be noted that the lenses 6 and 7, which formed an afocal system, are eliminated. Between the dichroic strip 8 and the dichroic cube 5, there is added an afocal system, constituted by a divergent lens 31 and a convergent lens 32, having the function of enlarging the beam of the laser while reducing its divergence. The convergent lens 33 is added on between the cube 5 and the image sensor 13 in order to focus, on to this image sensor 13, the parallel light rays that either come from the afocal system 31, 32 or come from the diode 29 and are collimated by the lens 28.

In FIG. 9, the rays coming from the reticle of the collimator 20 are shown at the same time as the rays coming from the diode 29: this corresponds to the case where the two boresighting steps are performed simultaneously. The rays coming from the reticle are shown with a single-headed arrow. The rays coming from the diode 29 are shown with a double-headed arrow.

Figure 10:
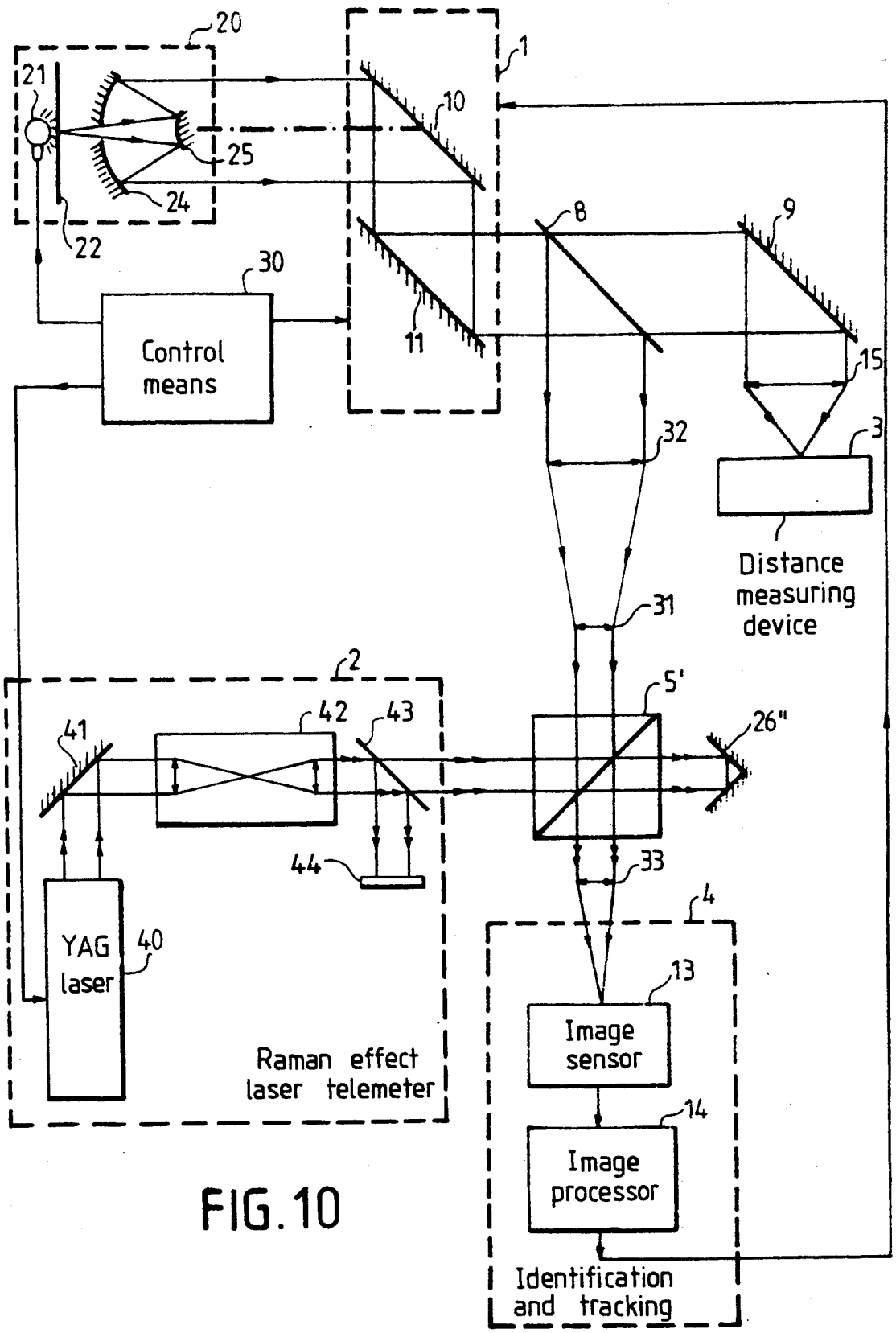

FIG. 10 gives a schematic view of a third exemplary embodiment adapted to an optronic system similar to those described earlier, but wherein the laser is a Raman effect laser. This Raman effect laser has a YAG type excitation laser 40, emitting at the 1.06 micrometer wavelength, and a Raman effect cell 42 which converts the energy of the excitation laser into a laser radiation with a 1.54 micrometer wavelength. A folding mirror 41 is interposed between the laser 40 and the cell 42. A filtering device is interposed between the cell 42 and the output of the telemeter 2. This filtering device is constituted by an absorber 44 and a dichroic strip 43, inclined by 45 degrees with respect to the optical axis of the laser beam coming out of the cell 42, to deflect the 1.06 micrometer wavelength rays towards the absorber 44. In a standard telemeter, this filtering device totally eliminates the rays having a 1.06 micrometer wavelength.

To constitute a collimated radiation source emitting in the optical axis of the output of the laser telemeter, it is possible to consider modifying the filtering device, so as to let a fraction of the rays with a 1.06 micrometer wavelength come out of the filtering device. This avoids the need to add on the previously described device, formed by an electroluminescent diode 29, a convergent lens 28 and a dichroic strip 27. By contrast, this variant has the drawback of making it necessary for the laser telemeter to function during the boresighting of the system.

The 1.06 micrometer wavelength may be dangerous for the eyes, while the 1.54 micrometer wavelength is not dangerous. In practice, the energy of the radiation necessary to achieve the boresighting is far below the maximum intensity permissible without danger to the eyes. Furthermore, it is always possible to provide for a rejection filter for the 1.06 micrometer wavelength, inserted between the dichroic cube 5 and the aiming head 1.

This third exemplary embodiment has the advantage of avoiding the need for adding an electroluminescent diode 29, a convergent lens 28 and a dichroic strip 27. It makes it necessary only to modify the output filter a little, so that it lets through a fraction of the rays at the 1.06 micrometer wavelength. The dichroic cube 5 is replaced by a dichroic cube 5' that is slightly different from the dichroic cube 5 described for the second and third exemplary embodiments.

Figure 11:
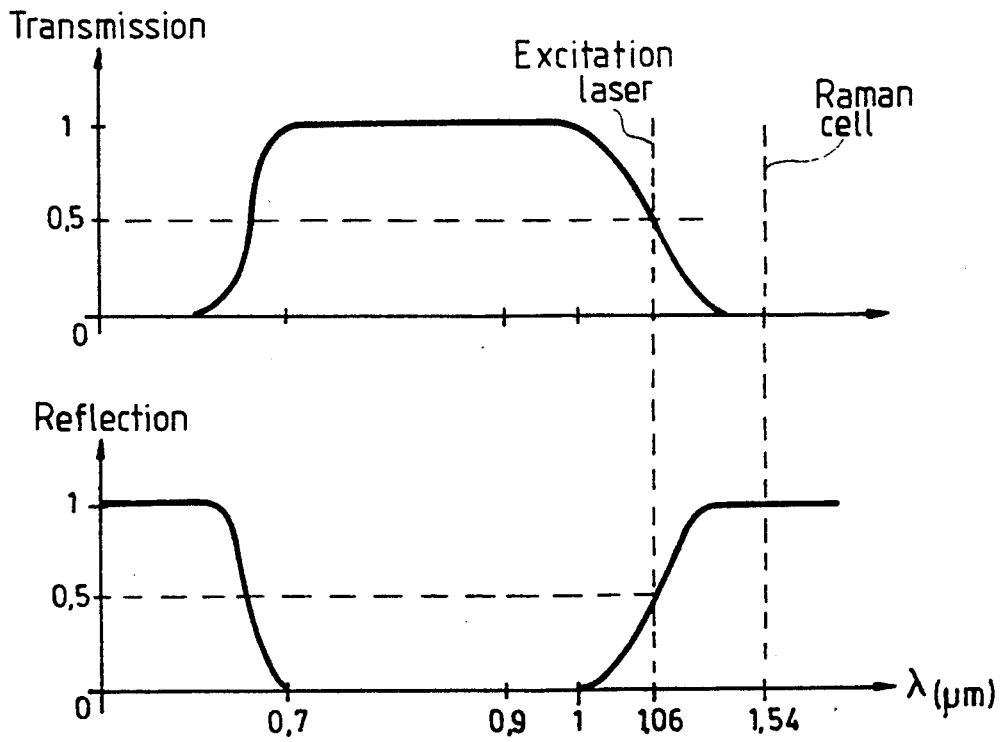
FIG. 11 shows graphs of transmission and reflection from a dichroic strip included in the exemplary embodiment shown in FIG. 10.

FIG. 11 shows the graph of the coefficient of transmission and the graph of the coefficient of reflection of the dichroic cube 5' as a function of the wavelength, for this third exemplary embodiment. The graph of the coefficient of transmission has a plateau, with a value of 1, between the 0.7 to 1 micrometer wavelengths, the transition to 0.5 taking place at 1.06 micrometers, which is the wavelength emitted by the excitation laser. The 1.54 micrometer wavelength, emitted by the Raman effect cell, falls within a range where the coefficient of transmission is zero and the coefficient of reflection is equal to 1. The making of a dichroic cube such as this is within the scope of those skilled in the art.

This embodiment of the collimated radiation source associated with the laser is quite compatible with the different exemplary embodiments of the above-described retroreflective means having glass micro-beads on the screen 22, or having a cube corner placed in the vicinity of the collimator 20.

What is claimed is:

1. An automatic boresighting device for an optronic system including a single pupil for a laser, a first and a second image sensor, working respectively in two different ranges of spectral sensitivity;

said device including:

a collimated radiation source, associated with the laser, emitting in the optical axis of the laser, with a wavelength belonging to the range of spectral sensitivity of the first sensor;

optical means reflecting the radiation from the source associated with the laser, to form a light spot on the first sensor;

a wide-band collimator including, in its focal plane, a screen with holes cut out in it, constituting a reticle illuminated by a source emitting in both ranges of spectral sensitivity, said collimator being placed so that it is visible simultaneously to the first image sensor and to the second image sensor, to form two images of the reticle on these sensors respectively;

means to measure the distance, on the first sensor, between the position of the image of the reticle and the position of the spot formed by the source, and to deduce a first boresighting correction therefrom;

means to measure the distance, on the second sensor, between the position of the image of the reticle and a reference point, and to deduce a second boresighting correction therefrom.

2. A device according to claim 1, for an optronic system wherein an optical channel for the laser and an optical channel for the first image sensor are separated by means of a dichroic device wherein said dichroic device has a coefficient of transmission and a coefficient of reflection that are close to 0.5 for the wavelength of the source associated with the laser.

3. A device according to claim 1, wherein the reflecting optical means include a layer of glass micro-beads covering the surface of the screen located in the focal plane of the collimator.

4. A device according to claim 1, wherein the reflecting optical means are constituted by a cube corner, placed in the vicinity of the collimator, the cube corner and the collimator being placed in two directions accessible simultaneously by the line of sight of the optronic system.

5. A device according to claim 2, wherein the reflecting means include a cube corner placed in the extension of the output of the laser beyond the dichroic device.

6. A device according to claim 1, wherein the source associated with the laser includes:

an electroluminescent diode; .

a semi-transparent strip;

a collimation device.

7. A device according to claim 1, for a system in which the laser is a Raman effect laser including: a Raman effect cell; an excitation laser emitting with a wavelength that is different from the wavelength of emission by Raman effect and belongs to the range of sensitivity of the first sensor; and a filtering device, designed to eliminate, at the output of the Raman effect laser, the radiation from the excitation laser; wherein the source associated with the Raman effect laser is constituted by the excitation laser, and wherein the filtering device has an attenuation such that it lets through a fraction of the radiation from the excitation laser, sufficient to form an image that is perceptible to the first sensor after a folding by the reflecting means.

* * * * *